United States Patent [19]

Lappin

[11] Patent Number: 4,834,868

[45] Date of Patent: May 30, 1989

[54] NEUTRALIZING OXIDATION PRODUCT COMPONENTS IN CONTINUOUS REREFINING OF USED OIL STOCKS

[75] Inventor: Francis J. Lappin, McCook, Ill.

[73] Assignee: Breslube USA, Inc., Breslau, Canada

[21] Appl. No.: 149,848

[22] Filed: Jan. 29, 1988

[51] Int. Cl.[4] ..... C10G 17/00; C10G 19/00; C10G 27/06; C10M 175/00

[52] U.S. Cl. ..... 208/184; 208/178; 208/179; 208/203; 208/283; 208/286; 208/357; 208/366

[58] Field of Search ..... 208/178, 179, 184, 203, 208/283, 286, 366, 357; 196/114, 127, 135

[56] References Cited

U.S. PATENT DOCUMENTS

| | | | |
|---|---|---|---|
| 1,281,354 | 10/1918 | Handy . | |
| 1,281,355 | 10/1918 | Handy . | |
| 1,295,308 | 2/1919 | Handy . | |
| 1,553,141 | 9/1925 | Clark . | |
| 1,655,660 | 1/1928 | Odom . | |
| 1,747,161 | 2/1930 | Clark . | |
| 1,919,655 | 7/1933 | Hoffman et al. . | |
| 1,951,497 | 3/1934 | Wallis | 196/114 |
| 2,125,325 | 8/1938 | Youker | 208/357 |
| 2,451,025 | 10/1948 | Ellender | 208/286 |
| 2,650,188 | 8/1953 | Reese et al. | 208/286 |
| 2,897,146 | 7/1959 | Waddill | 196/114 |
| 2,901,426 | 8/1959 | Waddill et al. | 208/366 |
| 3,304,255 | 2/1967 | Katsuta et al. . | |
| 3,790,474 | 2/1974 | Moffitt . | |
| 3,835,035 | 9/1974 | Fainman et al. . | |
| 4,101,414 | 7/1978 | Kim et al. | 208/184 |
| 4,252,637 | 2/1981 | Knorre et al. | 208/184 |
| 4,256,578 | 3/1981 | Kozar . | |
| 4,431,524 | 2/1984 | Norman . | |

*Primary Examiner*—Patrick P. Garvin
*Assistant Examiner*—E. D. Irzinski
*Attorney, Agent, or Firm*—Lockwood, Alex, Fitzgibbon & Cummings

[57] ABSTRACT

Rerefined used oil supplies are treated on a continuous basis so as to clarify the flow and so as to neutralize oxidation product components such as carboxylic acids which remain within the oil stocks after they have been rerefined by upstream procedures. The process is carried out on a continuous basis, and the treatment includes utilizing very low quantities of strong base for each volume of rerefined used oil that is thus treated. The treatment process includes continuously vacuum distilling a continuous flow of used oil stock and strong base composition.

6 Claims, 5 Drawing Sheets

NEUTRALIZING OXIDATION PRODUCT COMPONENTS IN CONTINUOUS REREFINING OF USED OIL STOCKS

BACKGROUND AND DESCRIPTION OF THE INVENTION

The present invention generally relates to a method and an apparatus for a continuous basis neutralization of oxidation product components found in rerefined used oil supplies. More particularly, the invention relates to a latter-stage treatment of used oil stock that had been previously subjected to rerefining treatments but which still contains oxidation products that are susceptible to treatment with a strong base or the like.

The rerefining of used lubricating oil stock typically includes a plurality of treatment procedures that are intended to result in the removal of undesirable components or to otherwise modify the used oil stock so that same generally equals or closely approximates the properties and appearance of virgin oil stock. Examples of systems in this regard include those disclosed in Kim et al U.S. Pat. No. 4,101,414. Systems such as these will usually include clarifying steps, typically near the end of the overall rerefining scheme, which are carried out in order to address difficult removal problems for specific components which are not removed during earlier stages of these rerefining processes. Examples of such latter-stage treatment procedures include those carried out in the clay contact still of said U.S. Pat. No. 4,101,414. Other examples of such latter-stage treatments include removal of halogenated polyphenyl materials from rerefined used oil stocks, an example of which is disclosed in O'Connell et al U.S. Pat. No. 4,623,448.

Latter-stage treatments which include distilling rerefined stock in the presence of clay typically also involve filtering the clay distilled stock and collecting the filtered stock as a rerefined oil product. This procedure requires the input of substantial quantities of acid activated clays and/or neutral clays and results in the formation of large amounts of filter cake of spent clay and residual oil. The input of these substantial quantities of clays represents a substantial expense, and the formation of such large quantities of filter cake presents an extremely difficult disposal problem.

These types of clay-contact distillation procedures that are utilized as a latter-stage treatment are intended to clean, clarify, deodorize and lower the acid value of the oil stock. These are beneficial results, but the disadvantages attendant to using such large volumes of clays are great and present an increasingly undesirable disposal problem which faces an industry that is otherwise highly favored because of its important contribution to the conservation of petroleum resources.

It has been known to utilize strong bases in the treatment of used petroleum and lubricant products. Often such treatments are other than latter-stage treatments which are carried out on stocks that have already been subjected to rerefining procedures. Also, such uses of strong bases and the like have heretofore typically been carried out in a batch type of procedure which tends to be overly time-consuming and generally inefficient.

By the present invention, used oil stocks that are being subjected to rerefining procedures include subjecting same to a latter-stage process that neutralizes oxidation product components on a continuous-flow basis. This continuous procedure includes providing and flowing a supply of rerefined used oil stock that is contaminated with oxidation product components. A supply of strong base is introduced into the supply of flowing stock. This stock is introduced into a distillation chamber and is vaporized and flows on a continuous basis into an array of impingement surfaces onto which the thus treated vaporized stock condenses for collection and outflow from the distillation chamber on a substantially continuous basis. The procedure of this invention is extremely cost efficient and very effective in neutralizing oxidation product components in a manner that does not generate large quantities of treatment byproduct which create a disposal or treatment problem.

It is accordingly a general object of this invention to provide an improved procedure for treating rerefined used oil stock with a basic treatment agent on a continuous basis.

Another object of the present invention is to provide an improved method and apparatus for continuously removing oxidation product components from rerefined used oil supplies without having to resort to the use of treatment agents that are difficult to dispose of, such as clay compositions.

Another object of the present invention is to provide an improved method and apparatus for rerefining used lubricating oil stocks, transformer oils and the like, including removal of oxidation product contaminants, particularly those that are acidic.

Another object of this invention is to provide an improved method and apparatus for effecting a latter-stage rerefining treatment of used oil stocks which results in color clarification, odor reduction and acid number reduction to substantially zero.

Another object of this invention is to provide an improved rerefining method and apparatus which substantially eliminates the production of a rerefined stock having a high chlorine content which would otherwise be a source of difficulties for subsequent latter-stage treatment steps, such as those utilizing a hydrotreater.

Another object of this invention is to provide a rerefining method and apparatus that will effectively treat waste oil stocks having relatively high chlorine contents.

Another object of the present invention is to provide an improved rerefining apparatus and method which utilizes extremely low concentrations of caustic or other bases while effectively and efficiently clarifying and neutralizing acid values of waste oil stock.

These and other objects, features and advantages of this invention will be clearly understood through a consideration of the following detailed description.

DESCRIPTION OF THE PARTICULAR EMBODIMENTS

Figure 1:
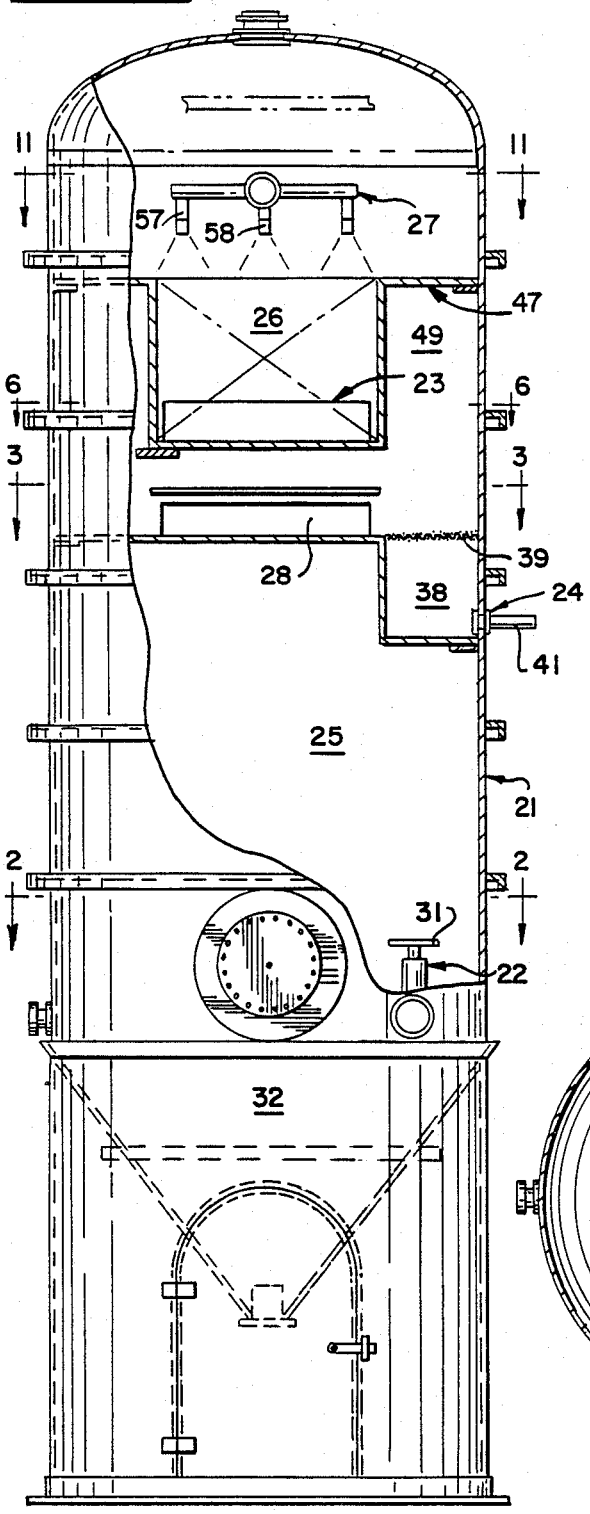
FIG. 1 is an elevational view, partially in broken-away cross-section, illustrating a typical distillation tower useful in carrying out the clarification and neutralization procedure of this invention.

A distillation tower, generally designated as 21, includes an inflow assembly 22, an impingement assembly 23, and an outflow assembly 24, as shown for example in FIG. 1. Distillation tower 21 includes a freespace section 25 wherein rerefined used oil vapor is allowed to flow upwardly into a mixing chamber 26. A spray assembly or distributor 27 provides a downwardly directed spray of rerefined oil composition. Oil droplets treated in accordance with this invention pass to a collector tray assembly 28, after which the thus collected treated oil flows into the outflow assembly 24, at which location it is drawn out of the distillation tower 21. As is discussed in more detail herein, a supply of strong base is added in a relatively low ratio to the rerefined used oil which enters the distillation tower. The treatment carried out by such strong base is substantially completed within the mixing chamber 26 and its associated impingement assembly 23 so that the rerefined used oil is clarified and neutralized when it is collected and removed by way of the outflow assembly 24.

Figure 2:
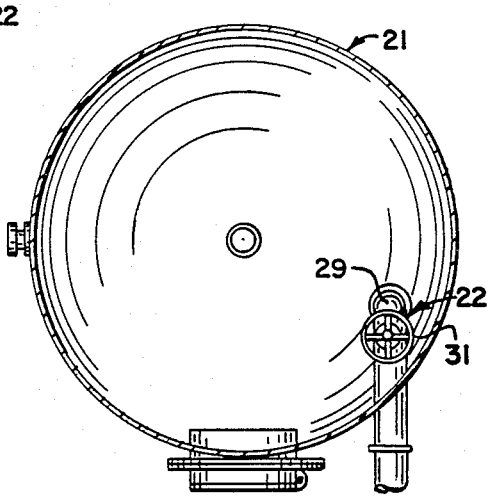
FIG. 2 is a cross-sectional view along the line 2—2 of FIG. 1.

Inflow assembly 22 is preferably generally tangentially mounted with respect to the circumference of the distillation tower, typically in a manner as generally illustrated in FIG. 2. Inflow assembly 22 includes an elbow member 29 having a generally upwardly directed portion with a deflector 31 which deflects at least some of the incoming heated oil composition in a somewhat generally downwardly oriented direction, after which the vaporized oil feed flows generally upwardly while unvaporized material falls into the bottoms portion 32 of the distillation tower 21. The preferred infeed helps to prevent the development of a vortex flow of vaporized oil stock within the distillation of tower 21.

In a typical situation, on the order of roughly 95 percent of the rerefined used oil feed which passes through the inflow assembly 22 will be in a vaporized state by the time it is fully clear of the inflow assembly, at which time it begins its assent within the free space section 25. The thus vaporized and upwardly flowing rerefined used oil stock composition continues to flow upwardly in the free space section 25 until it enters the mixing chamber 26.

The distillation tower 21 effects a simple distillation of the rerefined used oil stock composition which contains the strong base component. Such distillation is carried out at a low pressure or vacuum that is generally between 1 and 5 mm Hg, typically on the order of 1.5 mm Hg. Heated rerefined used oil stock is sprayed generally downwardly by the spray assembly or distributor 27. While vapor rises upwardly into the mixing chamber 26 and impingement assembly 23, a spray of oil stock from the spray assembly 27 enters the mixing chamber 26 from above. Because of these generally divergent flow directions and because the impingement assembly 23 has a large surface area for receiving the oil stock supplies, exceptionally good contact is made in order, to ensure completion of the reaction and neutralization activities and in order to continuously treat and collect the thus treated rerefined used oil stock.

Figure 3:
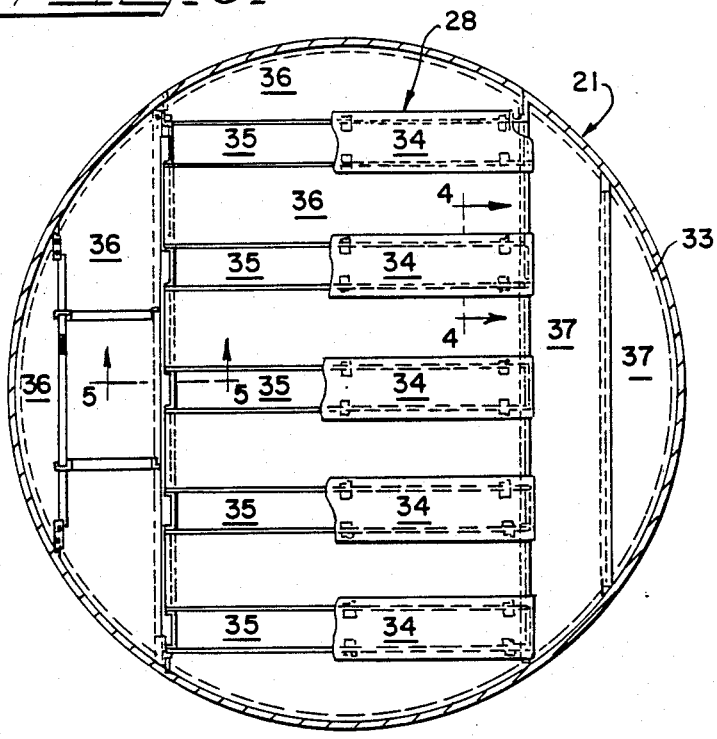
FIG. 3 is a cross-sectional view along the line 3—3 of FIG. 1.
Figure 4:
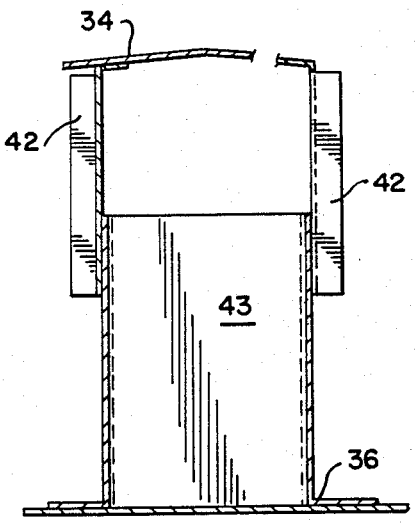
FIG. 4 is a cross-sectional view along the line 4—4 of FIG. 3.
Figure 5:
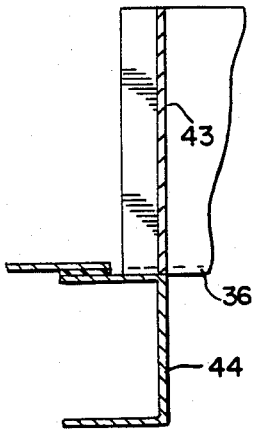
FIG. 5 is a cross-sectional view along the line 5—5 of FIG. 3.
Figure 7:
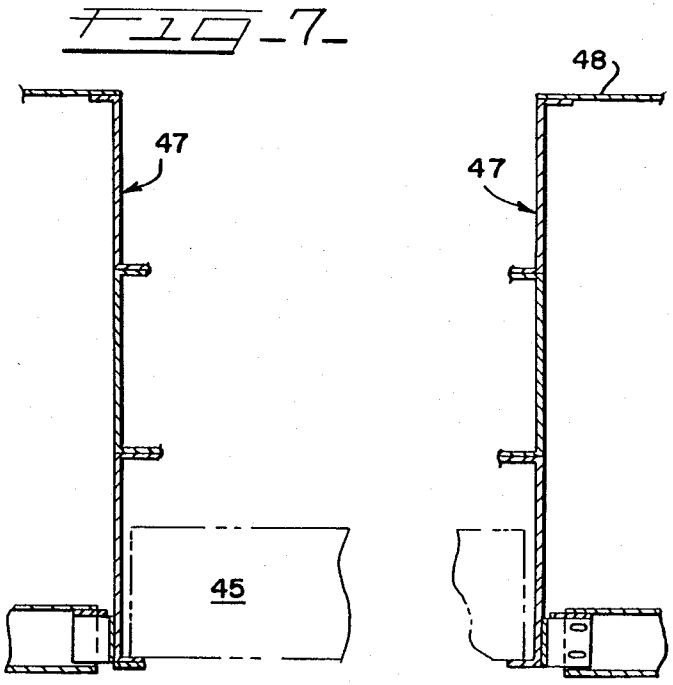
FIG. 7 is a cross-sectional view along the line 7—7 of FIG. 6, such being partially broken away.
Figure 8:
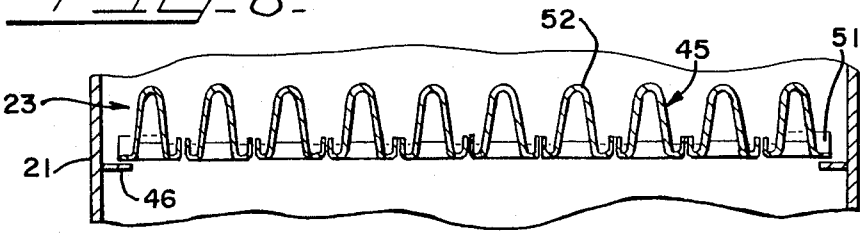
FIG. 8 is a cross-sectional view along the line 8—8 of FIG. 6.
Figure 6:
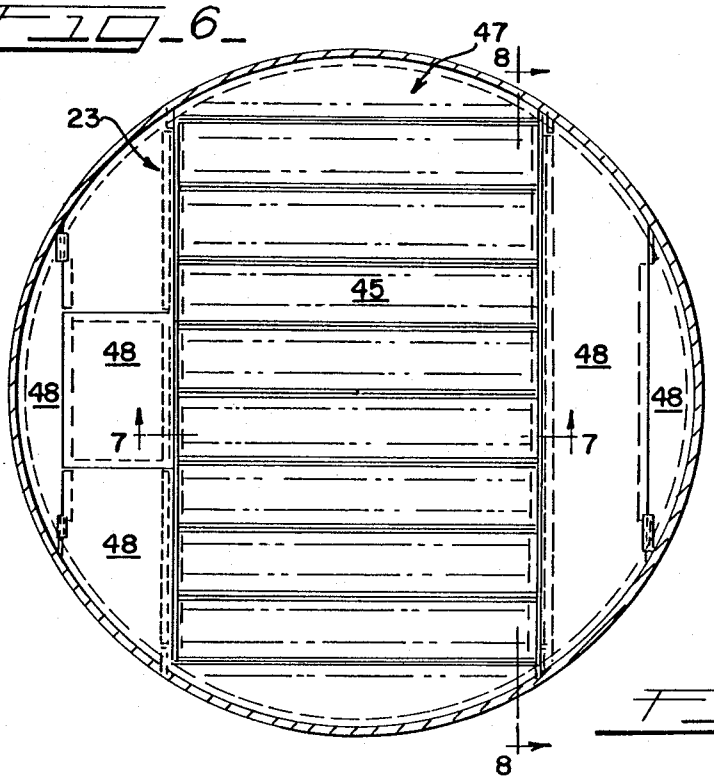
FIG. 6 is a top view of the impingement assembly, such being generally taken along the line 6—6 of FIG. 1.

FIG. 3 illustrates a preferred collector tray assembly 28. The illustrated assembly 28 is supported by a support ring 33 and includes means for collecting the liquified treated stock, including a plurality of hat members 34 and a plurality of open areas 35, as well as deck plates 36 and floor plates 37. As can be perhaps best seen in FIG. 1, a collection channel 38, which may include a screen 39 to prevent large objects from falling into the collection channel 38, provides a sump having a draw-off nozzle 41. Further details of the collector tray assembly 28 that is illustrated can be seen from FIGS. 4 and 5. Hats 34 are elevated by hat supports 42. End plates 43 and deck plates 36 are also shown, as is a support beam 44.

Further details of the impingement assembly 23 are illustrated in FIGS. 6 through 10. A packing support module 45 is suspended within the distillation tower 21 by a support ring 46 or the like. If necessary, such as when the mixing chamber 26 has a smaller horizontal cross-section than the distillation tower itself, a packing support shroud 47 and deck plates 48 are included, with the result that dead space 49 is provided within the distillation tower 21.

Packing module 45 includes a packing support tray 51 within which are positioned impingement members that provide enhanced surface area while permitting flow of lubricating stock therethrough. The illustrated impingement members include impingement plates 52 which, together with the packing support tray 51, support a plurality of packing rings 53 that are randomly dumped onto the packing support tray 51 and impingement plates 52. The packing support tray 51, the impingement plates 52 and the packing rings 53 include perforations of the type generally shown in FIGS. 9 and 10 so as to permit passage of vaporized used oil stock upwardly thereinto and the movement of condensed stock downwardly therethrough. Other types of impingement packing modules can be utilized so long as they provide adequate surface area for impinging and slowing down the rising vapor in order to condense same in association with the spray assembly or distributor 27.

Figure 11:
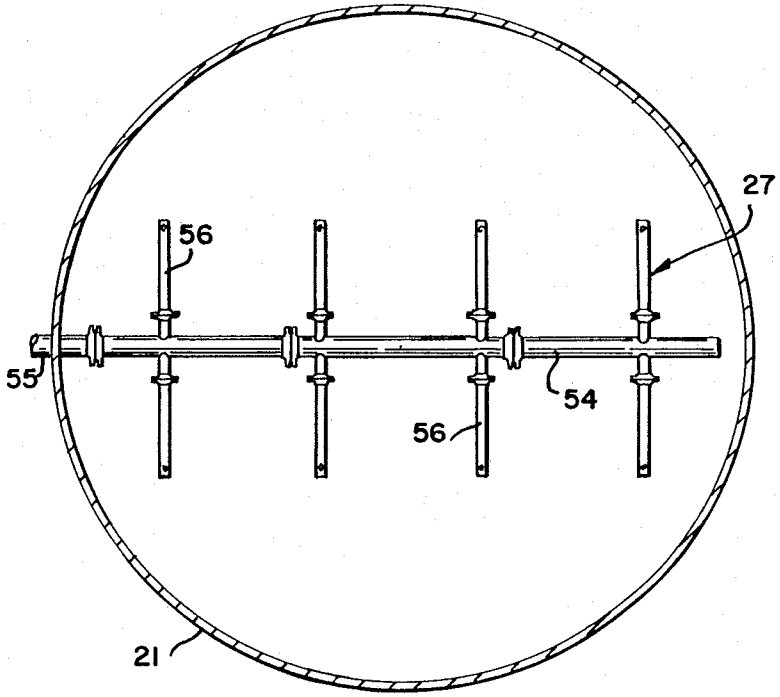
FIG. 11 is a cross-sectional view along the line 11—11 of FIG. 1.
Figure 9:
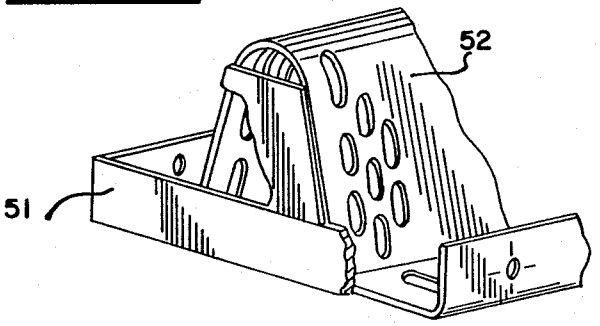
FIG. 9 is perspective view, partially broken away, of a component of the embodiment of the impingement assembly illustrated in FIG. 8.
Figure 10:
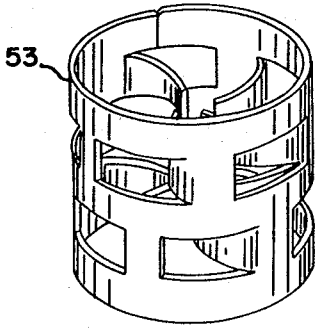
FIG. 10 is a perspective view of another component of the illustrated embodiment of the impingement assembly.

With specific reference to the spray assembly or distributor 27, further details of the illustrated distributor assembly 27 are provided in FIG. 11. A header 54 receives oil stock from an inlet conduit 55 for passage thereof to lateral conduits 56. Down pipes 57 and spray nozzles 58 downwardly depend from the spray assembly 27 in order to aid in directing the oil stock being distributed.

Figure 12:
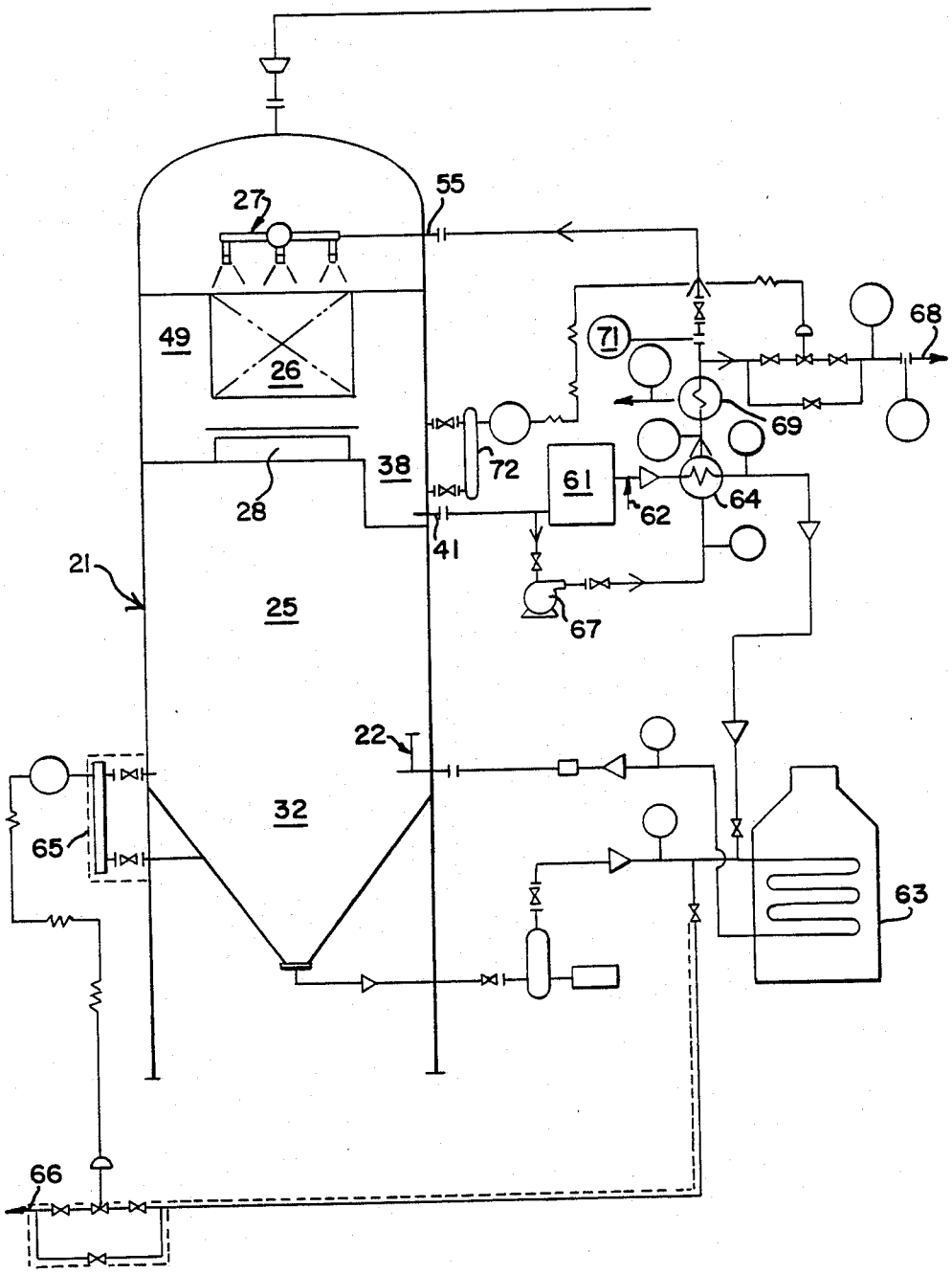
FIG. 12 is a generally schematic view of a latter-stage assembly of the illustrated rerefining system in accordance with this invention.

FIG. 12 more fully illustrates details of the apparatus and of the preferred processing features according to the invention. Rerefined used lubricating oils are fed from upstream rerefining equipment 61 in association with the inflow of strong base such as through an injector 62 or the like. Thereafter, the oil feed and base composition flow into a heater 63. When convenient, this flow path can include a heat exchanger 64. The heated oil and base composition flows out of the heater 63, to the inflow assembly 22 and into the freespace section 25 of the distillation tower 21 under conditions such that the oil composition vaporizes and rapidly flows upwardly toward the mixing chamber 26. Some of the stock falls to form the bottoms 32, the level of which is controlled by a sensor assembly 65, which indicates when bottoms can be removed and recycled through the heater 63 or otherwise transferred to a different location such as through outlet 66. Suitable temperature indicators, flow indicators, pressure indicators, level control devices and the like can be included in a generally known manner.

The vaporized oil stock composition flows out of the freespace section 25 and into the packed bed of the mixing chamber 26 for condensation in association with the downflow of oil stock from the spray assembly or distributor 27. Collection of thus treated oil stock is completed in the collector tray assembly 28 and the collection channel 38, such being typically at a temperature of about 350° F. Flow continues out of the distillation tower 21 by way of pump 67 for passage to storage by way of outlet 68. In the illustrated arrangement, the spray assembly or distributor 27 is fed with treated oil by passing same through a reflux flow path including the pump 67, a cooling heat exchanger 69, such as one passing cold water, a flow indicator 71, and other known regulation and control devices in order to provide the desired flow of oil stock to the spray distributor 27. This flow path can also include the heat exchanger 64 for transferring heat from the stock pumped through the pump 67 to the stock from the upstream rerefining equipment 61 in order to thereby preheat same while providing an initial cooling effect on the stock from the collection channel 38. A sensor assembly 72 having known level control equipment is designed to ensure that a supply of oil stock remains in the collection channel 38 in order to facilitate continuous operation of the apparatus.

With more particular reference to the upstream rerefining equipment 61, the equipment should provide a feed of rerefined used oil stock that is dry and preferably that has been treated in a manner by which metals and additives have been removed. Preferred upstream rerefining equipment 61 includes that of the type disclosed in U.S. Pat. No. 4,101,414 which is incorporated by reference hereinto. For example, such upstream rerefining equipment can carry out a predistillation procedure to strip away light oil fractions, followed by a vacuum distillation procedure under very low pressure conditions and aggressive treatment conditions such as those provided by forming a thin film that is heated, wiped and evaporated to provide a vacuum distilled feed of this upstream rerefining equipment 61.

Such rerefined feed will include oxidation products such as carboxylic acids. The feed typically will exhibit a certain degree of off color and may have a somewhat unpleasant odor. The present invention achieves color clarification and odor reduction as well as neutralization of the carboxylic acids and the like by contact with metallic hydroxides under especially advantageous heat and pressure conditions in order to facilitate dissociation of ionic species.

The neutralization aspects of this invention result in the formation of salts of carboxylic acids and water while using a minimum of strong base, typically a metallic hydroxide such as sodium hydroxide, potassium hydroxide or the like. For example, when the neutralization and clarification procedure of this invention is carried out at an oil stock flow rate of about 25 gallons per minute (or about 1500 gallons per hour), only about 50 pounds per hour of 50% sodium hydroxide solution as fed through injector 62 will successfully carry out the features of this invention. At these oil stock flow rates, successful treatment can be carried out by using only as little as about 4 gallons of caustic solution per hour of operation, depending of course on the actual make-up of the rerefined used oil stock feed. Based upon the volume of the rerefined used oil stock infeed, as little as about 0.25 volume percent of 50% metal hydroxide solution are needed. Typically, no more than about 0.5 volume percent of metal hydroxide solution would be needed. Generally speaking, most rerefined oil stocks treated according to this invention require not more than about 0.3 volume percent.

The following examples are set forth as illustrative embodiments of this invention and are not to be taken in any manner as limiting the scope of the invention which is defined by the appended claims.

EXAMPLE 1

Used oil stock was rerefined generally in accordance with U.S. Pat. No. 4,101,414 insofar as same was processed through the vacuum evaporator and stages upstream thereof. Same was not subjected to treatment within the clay contact still illustrated in that patent, but instead the vacuum evaporated rerefined oil stock was passed from this upstream rerefining equipment 61 and subjected to the continuous treatment discussed herein, including the passage of caustic by way of the injector 62. The rerefined feed stock was a 30° API feed flowing at 23 gallons per minute. To this continuous flow was added less than 0.08 gallons per minute of a solution of 50% sodium hydroxide. Only 0.3% of caustic, based on the volume of oil stock, were thus needed to treat each gallon of fresh feed of rerefined used oil. After passing through the heater 63, the composition of caustic and refined used oil entered the distillation tower 21 under temperature and pressure conditions of 570° F. and 5 mm Hg absolute. The temperature was selected so as to provide finally rerefined stock of a desired viscosity. When the feed entered the distillation tower, approximately 95% of it was substantially immediately vaporized. The thus treated oil was drawn out of the collection channel at a temperature of 350° F. and at a rate of 80.7 gallons per minute. Same was cooled in the heat exchanger 64 to a temperature of 302° F. Reflux typically proceeded at a rate of 60 gallons per minute, with the temperature thereof entering the spray assembly 27 being on the order of 200° F. The distillate that was not thus refluxed was cooled and was collected as a neutralized rerefined used oil stock at a rate of 20.7 gallons per minute. The procedure utilized approximately 4.5 to 5 gallons of caustic solution per hour at the flow rates specified herein.

This neutralized rerefined used oil stock had a clarified color and a reduced odor at least as good as that accomplished within a clay contact still. Unlike the capabilities of a clay contact still, which does not always adequately reduce the acid number of the stock, the processing according to this invention that was carried out as specified in this Example resulted in the stock having an acid number of 0. This caustic distillation procedure effectively treated carboxylic acids and neutralized the high chlorine content that would normally be expected in a stock that was instead subjected to clay contact still treatment or the like. With the flow rates specified in this Example, the yield of neutralized distillate to rerefined feed was in excess of 90%. This continuous unit has run for a number of months without requiring shutdown or any significant maintenance. This 90% plus yield is a substantial improvement over a yield on the order of 75% which is typical for a clay contact still treatment procedure. In addition, the cost of clarifying the rerefined stock is, at current costs, less than one-half of the cost required for a clay contact still process. For example, current costs with clay are on the order of 15 cents to 20 cents per gallon of oil stock, whereas the neutralization clarification process according to the present invention costs approximately 7 cents per gallon of rerefined oil stock.

EXAMPLE 2

A neutralizing and clarifying procedure is carried out in substantially the same manner as is specified in Example 1, except the strong base utilized is a potassium hydroxide solution.

EXAMPLE 3

Neutralizing and clarifying of rerefined used oil stock having a high chlorine content is carried out in substantially the same manner as is specified in Example 1. The procedure effectively completely neutralizes the chlorine content so as to avoid difficulties associated with any further processing of the rerefined used oil stock.

It will be understood that the embodiments of the present invention which have been described are illustrative of some of the applications of the principles of the present invention. Numerous modifications may be made by those skilled in the art without departing from the true spirit and scope of the invention.

I claim:

1. A process for continuously neutralizing oxidation product components in rerefining used oil stock supplies, comprising a process that is carried out on a continuous flow basis and that includes:

providing a supply of used oil stock that has been rerefined and that is contaminated with an oxidation product component;

injecting a flow of a strong base solution into a flow of said rerefined and contaminated used oil stock, said injected flow of strong base solution is at a flow rate that is not greater than about 1% by volume of the flow volume of said oil stock, in order to form a feed flow of oil composition including said rerefined oil stock and said strong base;

flowing said feed flow of rerefined oil composition of oil stock and strong base into a vacuum distilling tower providing low pressure conditions and vaporizing said composition within the vacuum distilling tower to form a vaporized composition that flows upwardly within the vacuum distilling tower;

condensing said upwardly flowing vaporized composition and permitting same to fall into a collection means so as to form a treated rerefined used oil flow, said condensing step including impinging the rising vapor composition of oil stock and strong base onto a convoluted surface of an impingement assembly within the vacuum distilling tower and generally downwardly spraying a recycled liquid flow of said treated rerefined used oil stock onto the impingement assembly, contacting said used oil stock and said strong base on the surface of the impingement assembly in order to ensure completion of neutralization of oxidation product component of said used oil stock; and collecting said treated rerefined used oil flow and withdrawing same out of the vacuum distilling tower to provide treated rerefined used oil stock, and said collecting step recovers on the order of approximately 90% or above of the rerefined used oil stock that is said feed flow to the vacuum distilling tower.

2. The process according to claim 1, wherein said step of providing a supply of used oil stock that has been rerefined includes vacuum distilling used oil stock under very low pressure conditions for removing a majority of impurities from used oil stock.

3. The process according to claim 2, wherein said step of removing a majority of impurities results in said rerefined and contaminated used oil stock that includes a carboxylic acid as the oxidation product component, and said process substantially reduces the acid value of the rerefined used oil stock to approximately zero.

4. The process according to claim 1, wherein said strong base is a metal hydroxide solution.

5. The process according to claim 1, wherein said injecting step incorporates not more than approximately 0.5 volume percent of strong base solution into the oil composition, based on the volume of oil composition.

6. The process according to claim 1, wherein said injecting step incorporates approximately 0.3 volume percent or less of strong base solution, based on the volume of the oil composition.

* * * * *